US009301657B2

(12) United States Patent
Miller et al.

(10) Patent No.: US 9,301,657 B2
(45) Date of Patent: Apr. 5, 2016

(54) SKIN CARE DEVICE WITH INTEGRATED CLEANSER

(71) Applicant: L'Oreal, Paris (FR)

(72) Inventors: Zane Bowman Allen Miller, Seattle, WA (US); Kenneth A. Pilcher, Seattle, WA (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 14/143,366

(22) Filed: Dec. 30, 2013

(65) Prior Publication Data

US 2015/0182078 A1 Jul. 2, 2015

(51) Int. Cl.
*A46B 13/04* (2006.01)
*A47K 7/04* (2006.01)

(52) U.S. Cl.
CPC ..... *A47K 7/04* (2013.01)

(58) Field of Classification Search
CPC ..... A47L 13/17; A47L 13/26; A46B 3/02; A46B 13/04; A46B 13/008; A47K 7/03; A47K 7/04
USPC ..... 15/104.93, 104.94, 28, 29; 401/19, 24, 401/49, 52, 88
See application file for complete search history.

(56) References Cited

U.S. PATENT DOCUMENTS

| | | | | |
|---|---|---|---|---|
| 846,346 | A * | 3/1907 | Rich | 401/22 |
| 1,909,146 | A | 5/1933 | Bohanan | |
| 3,196,299 | A * | 7/1965 | Kott | 310/81 |
| 4,875,791 | A | 10/1989 | Hassan | |
| 5,134,775 | A | 8/1992 | Althaus | |
| 6,298,558 | B1 | 10/2001 | Tseng | |
| 6,584,690 | B2 | 7/2003 | Orloff | |
| 7,320,691 | B2 | 1/2008 | Pilcher | |
| 7,607,188 | B2 * | 10/2009 | Singhal | 15/104.94 |
| 8,261,395 | B2 | 9/2012 | Lazarre | |
| 2005/0278876 | A1 * | 12/2005 | Roth et al. | 15/28 |
| 2005/0278877 | A1 | 12/2005 | Akridge | |
| 2009/0188528 | A1 * | 7/2009 | Junkins | 134/6 |

FOREIGN PATENT DOCUMENTS

| | | | |
|---|---|---|---|
| EP | 0313184 | B1 | 6/1992 |
| EP | 1157792 | A1 | 11/2001 |
| EP | 1465509 | B1 | 10/2007 |
| EP | 2591895 | A1 | 5/2013 |
| FR | 2196138 | A1 | 3/1974 |
| GB | 1208149 | A * | 10/1970 |
| GB | 1440202 | A | 6/1976 |
| WO | 99/32009 | A1 | 7/1999 |

* cited by examiner

*Primary Examiner* — Laura C Guidotti
(74) *Attorney, Agent, or Firm* — Christensen O'Connor Johnson Kindness PLLC

(57) ABSTRACT

A cleansing workpiece suitable for use with a personal care appliance. The cleansing workpiece includes a cleanser and a cleansing component, such as a number of tufts each having a plurality of bristles. In use, the cleansing workpiece can be rotated, reciprocated, oscillated, etc., over a subject's skin in order for the cleansing workpiece to dispense or apply a quantity of the cleanser onto the subject's skin and/or for the cleansing component to clean, massage, and/or exfoliate a subject's skin with the aid of dispensed cleanser. The cleanser may be continuously applied to the subject's skin as the cleansing component.

11 Claims, 9 Drawing Sheets

SKIN CARE DEVICE WITH INTEGRATED CLEANSER

BACKGROUND

Current cleansing routines, facial or otherwise, typically include a three step process: apply cleanser, use cleansing device, rinse. If for some reason, an inadequate amount of cleanser was applied prior to use of the cleansing device, it is necessary to stop using the device, reapply additional cleanser and then resume using the cleansing device.

SUMMARY

Examples of the present disclosure seek to address the problems associated with the three step process set forth above, among others, by integrating a cleanser or a cleanser dispenser with a cleansing device, such as a brush, in a unique and beneficial manner. In this regard, examples described herein relate to a combination cleanser and cleansing device. Not only does this combination cleanser/cleansing device reduce the amount of time and number of steps involved in a cleansing routine, it may also allow for a constant rate of cleanser application at the site of cleansing while the cleansing device is in operation.

In accordance with aspects of the present disclosure, a cleansing workpiece is provided. The cleansing workpiece includes a cleansing body having an interface configured for coupling to a powered personal appliance, a cleansing component extending outwardly from the cleansing body, and a cleanser carried by the cleansing body. In some embodiments, the cleansing component includes a plurality of tufts each including a plurality of bristles. In other embodiments, the cleansing component may include a sponge, etc.

In accordance with another aspect of the present disclosure, a cleansing workpiece is provided. The cleansing workpiece includes a cleansing body having an interface configured for coupling to a powered personal appliance, a plurality of tufts each including a plurality of bristles extending outwardly from the cleansing body, and means for dispensing a cleanser onto a subject's skin. In some embodiments, said means for dispensing a cleanser is carried by the cleansing body.

In accordance with another aspect of the present disclosure, a powered cleansing device is provided. The device includes a powered handle having a motor and a cleansing workpiece mounted to the powered handle and configured to be moved by the motor. In some embodiments, the cleansing workpiece includes a plurality of tufts each including a plurality of bristles extending outwardly from the cleansing workpiece, and a cleanser carried by the cleansing workpiece.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following discussion provides examples of devices that relate to skin care, and more particularly, to cleansing workpieces that incorporate a cleanser. Examples of the cleansing workpieces can be configured to be powered by a personal care appliance. The cleansing workpieces when powered by a personal care appliance aim to provide an oscillating, reciprocating, and/or rotational motion for improved cleaning and/or massaging of a subject's skin. As will be described in more detail below, examples of the cleansing workpieces disclosed herein provide for the dispensing of a cleanser for use with cleansing components, such as bristles, sponges, etc., of the cleansing workpiece. As used herein, cleanser, cleansing agent, cleaning agent, etc., may include any soluble formulation, composition, preparation, etc., that is capable of cleansing a subject's skin. Cleansing a subject's skin includes but is not limited to the removal of make-up, dead skin cells, oil, dirt, and other types of pollutants from the skin of the subject's body, including the face. The cleansers can be in solid or liquid form, and in some examples may include soaps, detergents, etc. The cleanser may optionally include toners, moisturizers, fragrances, dyes, essential oils, medications, etc.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. Further, it will be appreciated that embodiments of the present disclosure may employ any combination of features described herein.

Figure 1:
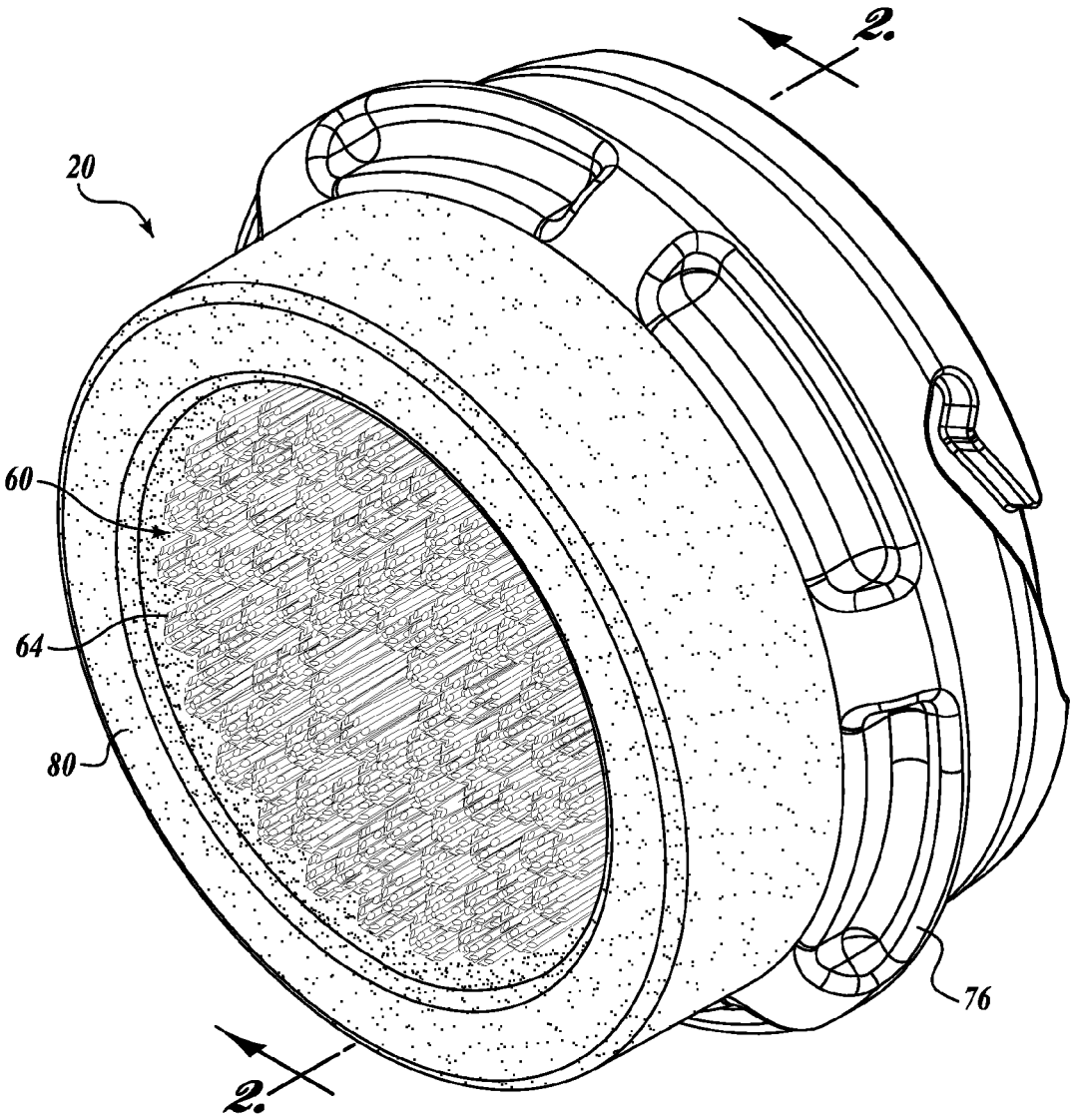
FIG. 1 is a perspective view of one example of a cleansing workpiece formed in accordance with aspects of the present disclosure.

Turning now to FIG. 1, there is shown one example of a cleansing workpiece, generally designated 20, formed in accordance with aspects of the present disclosure. The cleansing workpiece 20 is suitable for use with a personal care appliance, such as appliance 22, illustrated in FIGS. 8 and 9. The cleansing workpiece 20 in some embodiments includes a cleanser 80 and a cleanser component in the form of a number of tufts 60 each having a plurality of bristles 64. In use, the cleansing workpiece 20 can be rotated, reciprocated, oscillated, etc., over a subject's skin in order for the cleansing workpiece 20 to dispense or apply a quantity of the cleanser 80 onto the subject's skin and/or for at least some of the bristles 64 of the tufts 60 to clean, massage, and/or exfoliate a subject's skin with the aid of dispensed cleanser 80. As will be described in more detail below, the cleanser 24 in some embodiments may be continuously applied to the subject's skin as the bristles of the tufts contact the subject's skin.

Prior to describing the cleansing workpiece 20 in more detail, one example of a personal care appliance 22 that may be employed to impart an oscillating motion to the cleansing workpiece 20 will be described in some detail. While the personal care appliance 22 is one type of appliance that can be practiced with embodiments of the present disclosure, it will be appreciated that the cleansing workpiece 20 is suitable for use with a wide range of oscillatory, rotational, and reciprocating motion generating devices.

Figure 8:
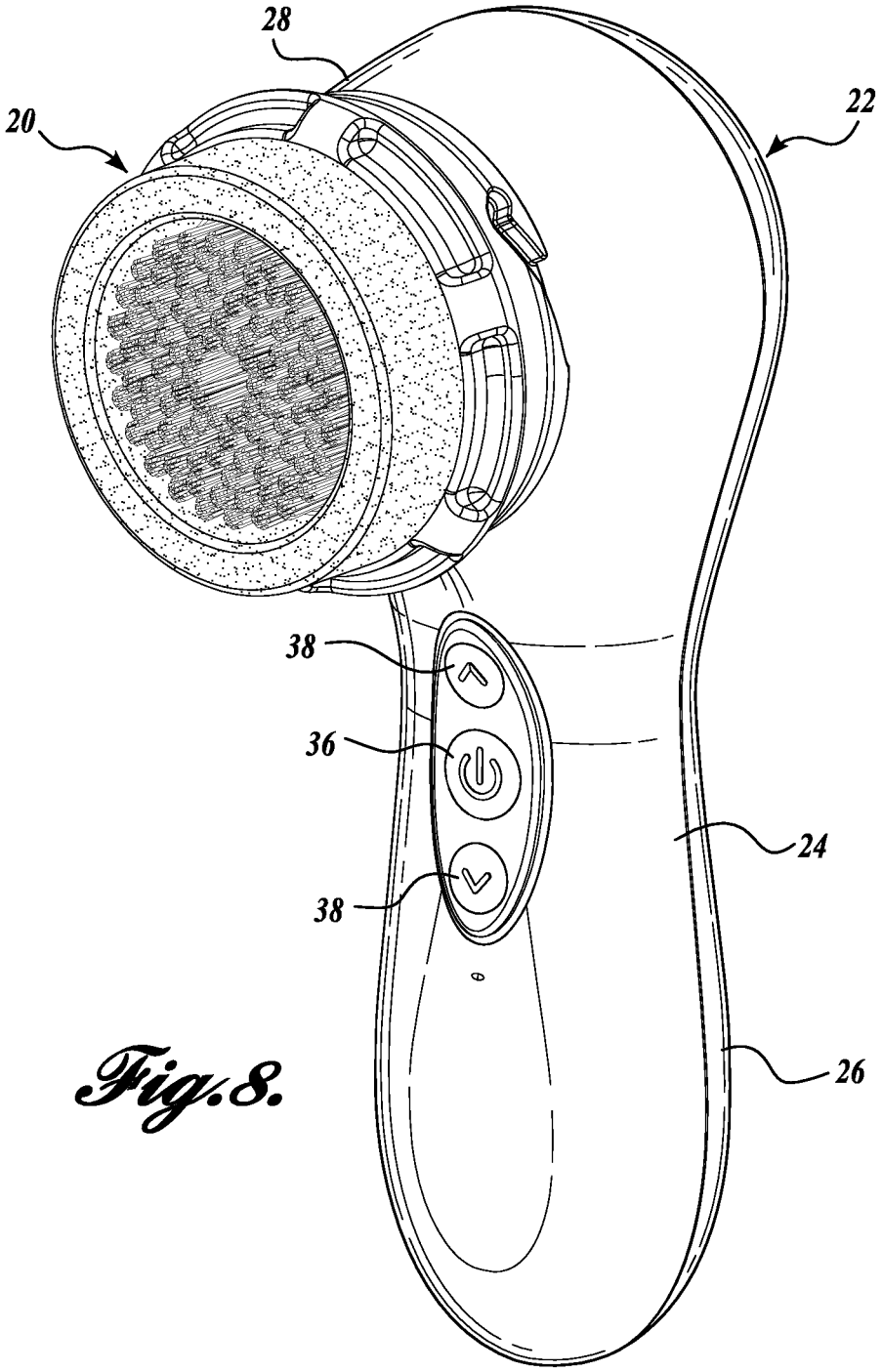
FIG. 8 is a perspective view of one example of a personal care appliance on which the brush head of FIG. 1 is mounted.
Figure 9:
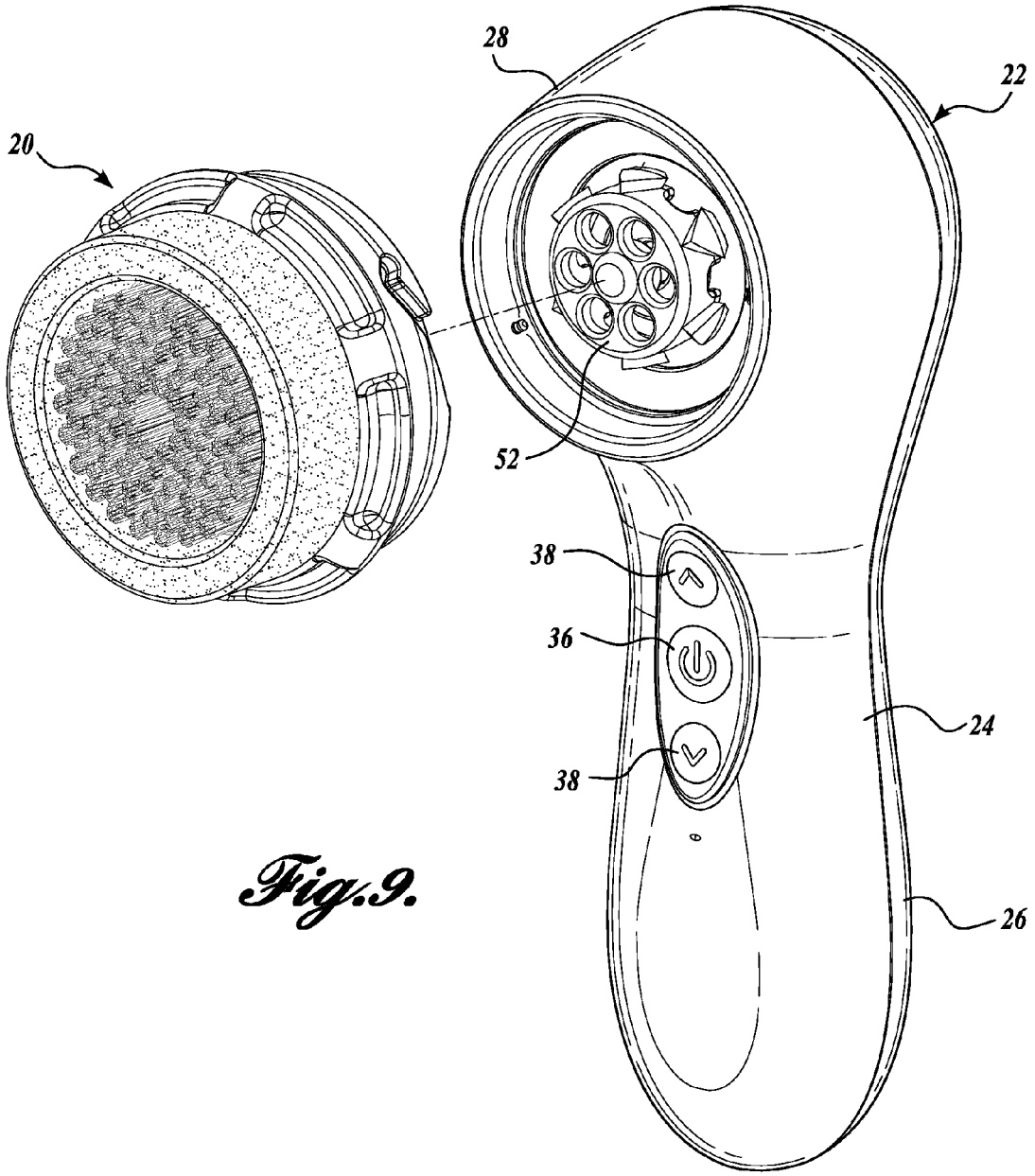
FIG. 9 is a perspective view of the personal care appliance of FIG. 9 with the brush head exploded therefrom.

Turning now to FIGS. 8 and 9, there is shown one example of the personal care appliance 22. The appliance 22 includes a body 24 having a handle portion 26 and a head attachment portion 28. The head attachment portion 28 is configured to selectively attach a workpiece or head, such as cleansing workpiece 20, to the appliance 22. The appliance body 24 houses the operating structure of the appliance. As shown in block diagrammatic form in FIG. 9, the operating structure in one embodiment includes a drive motor assembly 30, a power storage source 32, such as a rechargeable battery, and a drive control 34 that includes an on/off button 36 (see FIG. 8) configured and arranged to selectively deliver power from the power storage source 32 to the drive motor assembly 30. In some embodiments, the drive control 34 may also include a power adjust or mode control buttons 38 (see FIG. 8) coupled to control circuitry, such as a programmed microcontroller or processor, which is configured to control the delivery of power to the drive motor assembly 30. The drive motor assembly 30 in some embodiments includes an electric drive motor 40 that drives an attached head, such as cleansing workpiece 20, via a drive shaft or armature 42.

When the cleansing workpiece 20 is mounted to the head attachment portion 28, the drive motor assembly 30 is configured to impart motion to the cleansing workpiece 20. The drive motor assembly 30 may be configured to operate the cleansing workpiece 20 at sonic frequencies, typically in the range of 40-350 Hz, oscillating the cleansing workpiece 20 back and forth within a range or amplitude of 3-45 degrees. In some embodiments, as will be described in more detail below, the cleansing workpiece 20 can be operated in loaded or unloaded conditions at frequencies from about 80 Hz to about 220 Hz and with a range or amplitude of about 6 degrees to about 20 degrees. It will be appreciated that the operation frequency and oscillation amplitude imparted to the cleansing workpiece 20 by the drive motor assembly 30 could be varied, depending in part on its intended application and/or characteristics of the cleansing workpiece, such as its inertial properties, etc.

Figure 2:
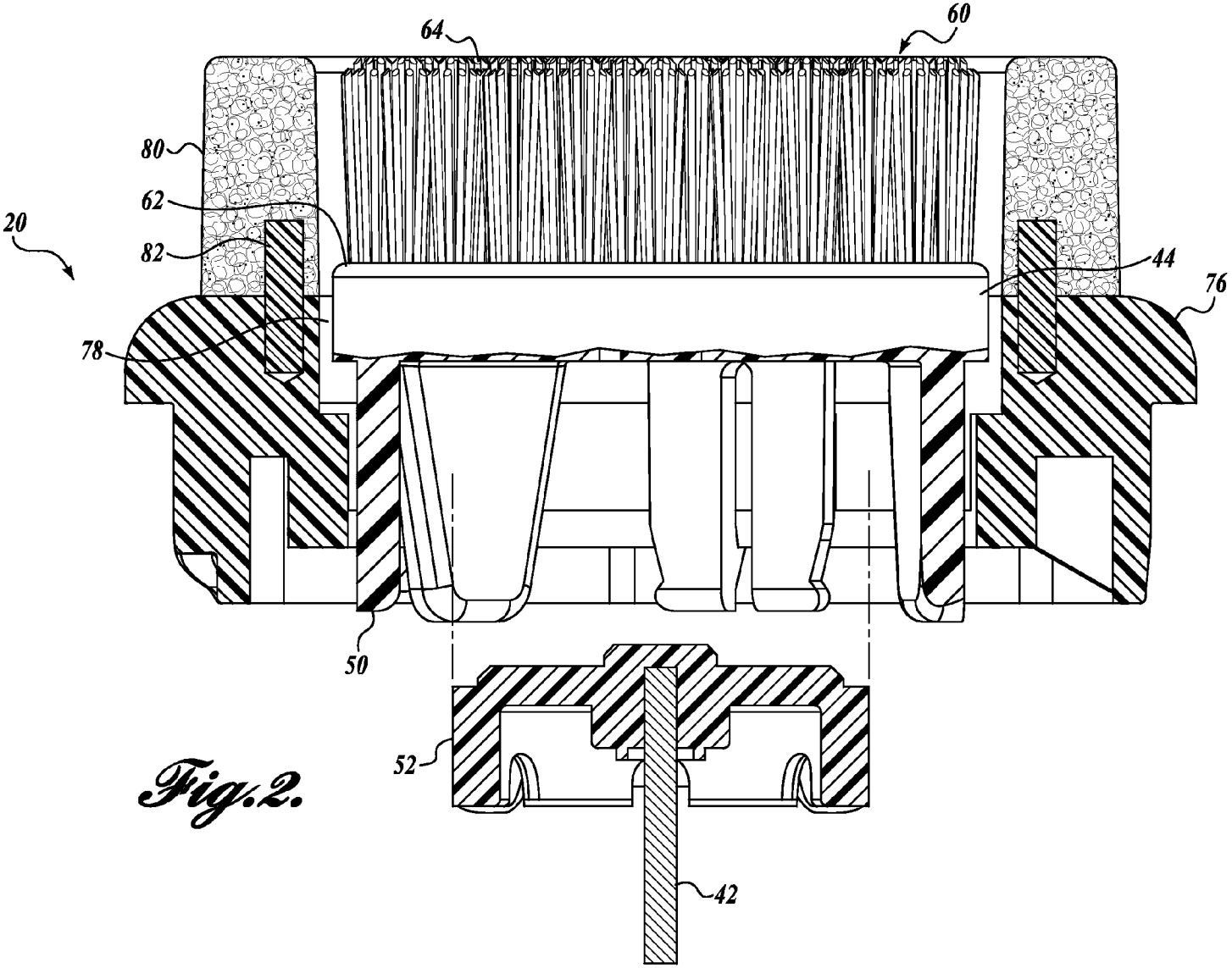
FIG. 2 is a cross-sectional view of the cleansing workpiece of FIG. 2.
Figure 10:
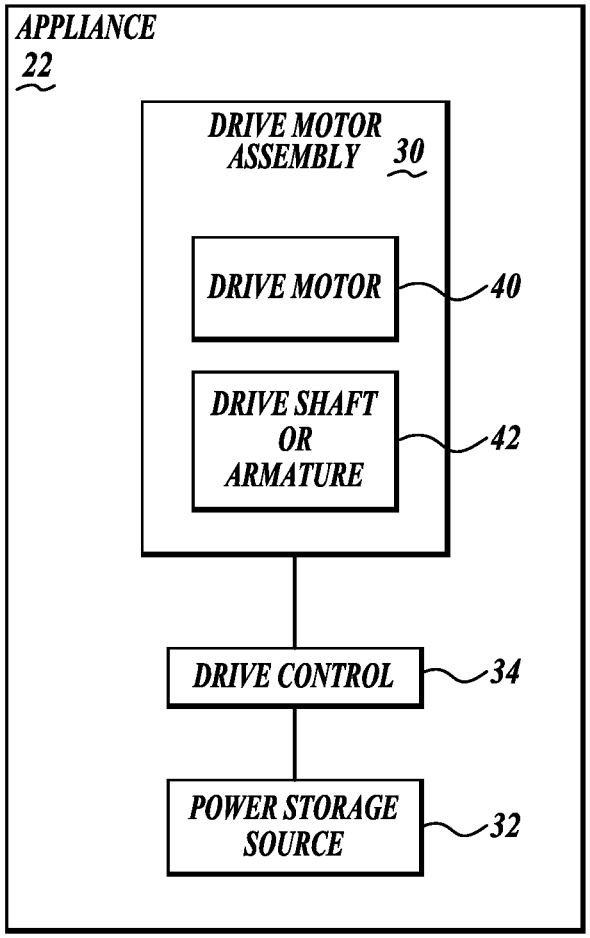
FIG. 10 is a functional block diagram of several components of the personal care appliance of FIG. 8.

Turning now to FIGS. 1-2, one example of the cleansing workpiece 20 will be described in more detail. As best shown in FIG. 2, the cleansing workpiece 20 includes a movable cleansing body 44 configured to interface directly or indirectly with the drive shaft or armature 42 of the drive motor assembly 30 (see FIG. 10) at a first or inner end 50. In the embodiment shown, the body 44 has a generally cylindrical cross-section, although other geometrical cross-sections (i.e., triangular, elliptical, lobular, square, etc.) may be employed. The body 44 can be constructed out of plastic, such as nylon, polypropylene, polyurethane, polyethylene, etc., although other materials may be utilized, including lightweight metals, such as aluminum, titanium, etc.

The cleansing workpiece 20 in some embodiments also includes a plurality of tufts 60 disposed at an opposite, second or outer end 62 of the body 48. The tufts 60 are spaced apart from one another and include a plurality (e.g., 40-180) of bristles 64. The bristles 64 extend upwardly from a brush face or outer surface 68 of the body 44.

The bristles of the tufts in some embodiments of the present disclosure have a length of about 0.20 inches ((5.08 millimeters)) to about 1.2 inches (30.48 millimeters) or greater and a diameter in the range of about 0.003 inches (0.0762 millimeters) to about 0.020 inches (0.508 millimeters) or greater. The bristles can be constructed out of a variety of materials, such as polymers and co-polymers. In some embodiments, the bristles may be constructed out of polybutylene terephthalate (PBT), such as DuPont™ Crastin®, polyethylene terephthalate (PET), such as DuPont™ Rynite®, nylons of differing blends, such as DuPont™ Zytrel®, polyester, a thermoplastic elastomer (TPE), coextruded elastomers, polypropylene, polyethylene, such as DuPont™ Bynel®, combinations or blends thereof, etc. In some embodiments, the bristles may have cross-sections including but not limited to rectangular, diamond, hollow, rectangular, X-shape, quadralobal, etc. Additionally, the outside surface of the bristle length may be crimped or wavy or with bumps or other texturing. Further, the bristles may be treated with anti-microbial agents in some embodiments or coated or compounded with an anti-microbial material, such as silver zeolites, zinc, copper, gold, etc., or other organic additives. End finishing of one or more bristles can also be varied to provide tactile and exfoliating properties, some of which may be smooth polished end rounding, surface texturing, tapered, raw cut ends, split, or soft elastomeric, etc.

Returning to the embodiments of FIGS. 1-2, the cleansing workpiece 20 further includes an outer retainer 76. The outer retainer 76 includes a central opening 78 sized and configured to surround the perimeter of the movable cleansing body 44. In the embodiment shown in FIGS. 1-2, the cleanser 80 is mounted to the outer retainer 76. In this embodiment, the cleanser 80 is in solid form, and can include, for example, a soap or detergent. As assembled, the cleanser 80 is suitably coupled to the outer retainer 76. The coupling can be mechanical, such as posts 82, spike(s), bands, clamps, etc., chemical (e.g., adhesives, etc.), etc., as known in the art. In the embodiment shown, the cleanser 80 is in the form of a ring, which extends outwardly from the outer retainer 76 a distance substantially equal to or greater than the bristles 64.

In some embodiments, the body 44 and the outer retainer 76 together include an attachment system configured to provide selective attachment of the cleansing workpiece 20 to the head attachment portion 28 of the personal care appliance 22. When attached to the personal care appliance 22 by the attachment system, the following occurs: (1) the movable body 44 is operatively connected to the drive motor assembly 30, for example, via a drive boss 52, in a manner that provides motion thereto; and (2) the outer retainer 76 fixedly secures the cleansing workpiece 20 to the head attachment portion 28 of the appliance 22. Accordingly, the attachment system in some embodiments provides a quick and easy technique for attaching and detaching the cleansing workpiece 20 to the personal care appliance 22. It will be appreciated that the attachment system also allows for other personal care heads to be attached to the appliance, and allows for replacement cleansing workpieces 20 to be attached to the appliance, when desired.

It will be appreciated that any attachment system can be employed to provide either tooled or tool-less techniques for selectively attaching the cleansing workpiece 20 to a personal care appliance, such as appliance 22, in a manner that: (1) provides motion to the body 44; and (2) maintains the connection between the body 44 and the drive motor assembly 30. For example, in some embodiments, the body 44 includes a coupling interface configured to cooperatingly connect to a drive shaft or armature, such as armature 42, of an associated drive motor assembly 30 in a manner that transmits motion to the body 44 while fixedly securing the body 40 thereto. In these embodiments, the cleanser 80 can be coupled to the movable body 40 and the outer retainer 76 can be omitted.

Figure 3:
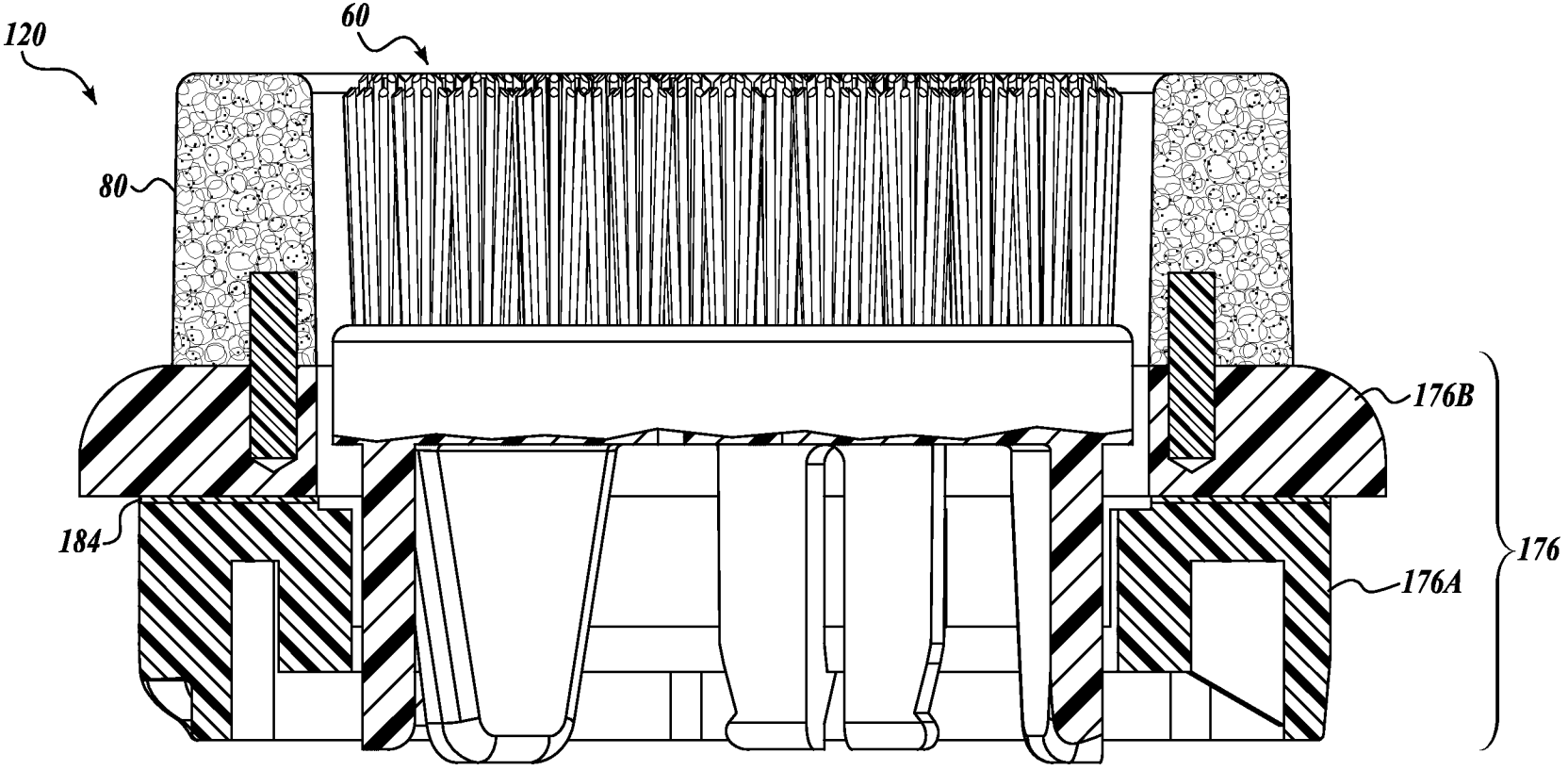
FIG. 3 is a cross-sectional view of another example of a cleansing workpiece formed in accordance with aspects of the present disclosure, wherein the workpiece is in a compressed state.
Figure 4:
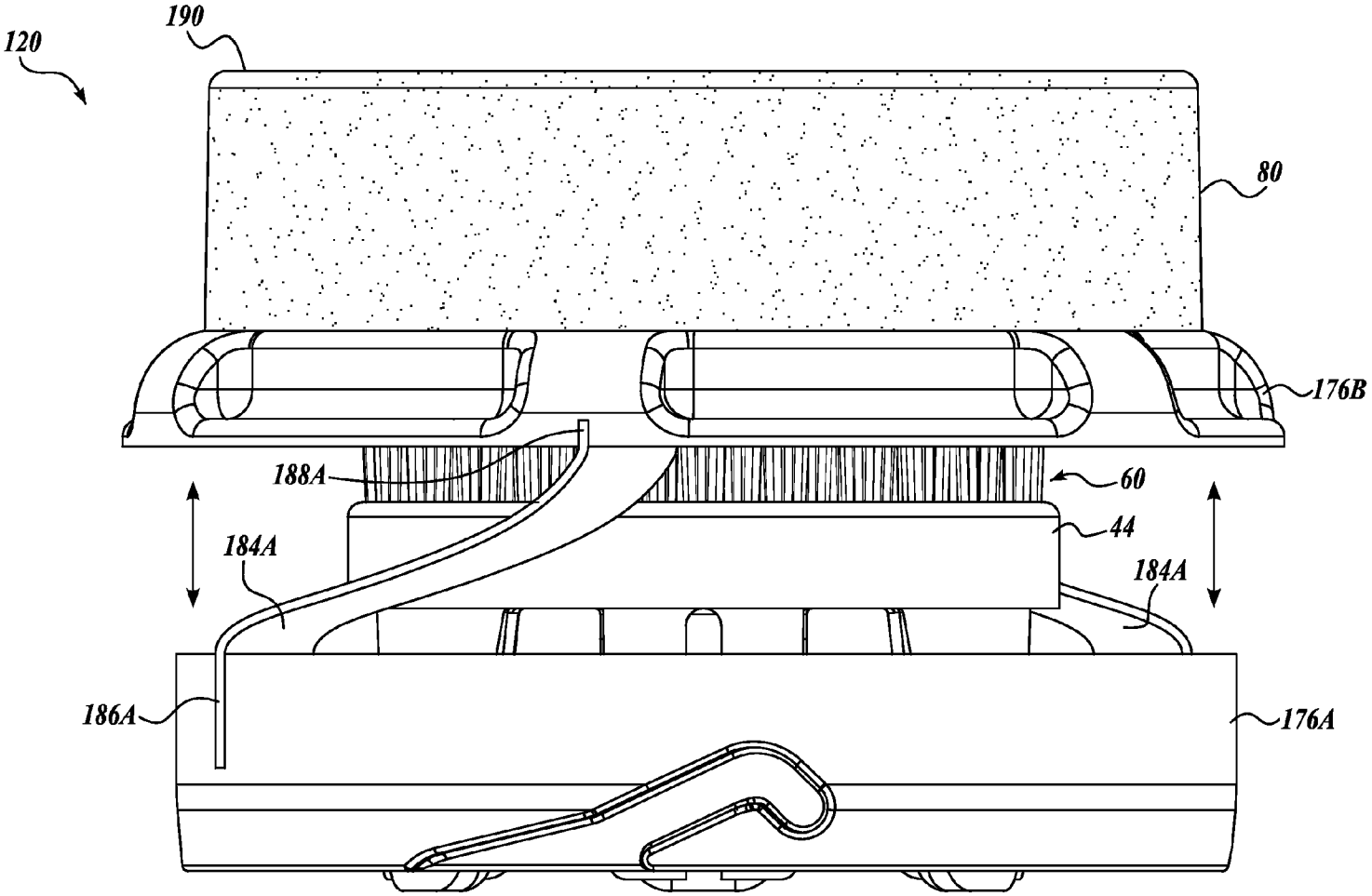
FIG. 4 is a side view of the cleansing workpiece of FIG. 3 in the uncompressed state.

FIGS. 3-4 depict another example of a cleansing workpiece 120 formed in accordance with aspects of the present disclosure. The cleansing workpiece 120 is substantially similar in construction and operation as the cleansing workpiece 20 except for the differences that will now be described. As shown in FIGS. 3 and 4, the outer retainer 76 in this example is formed in at least two discrete parts, base section 176A and upper section 176B, coupled together via a biasing device 184. The biasing device 184 in some embodiments includes but is not limited to a compression coil spring, a number of leaf spring segments, a Belleville washer (also known as a coned-disc spring), elastomeric bushings, just to name a few. In the embodiment shown in FIG. 4, the biasing device 184 includes a number of curved or slightly coiled leaf spring segments 184A, which are disposed around the perimeter of the outer retainer base section 176A. First ends 186A of segments 184A are suitably anchored to the top of the base section 176B while opposite, second ends 188A of segments 184A are anchored into the bottom of the upper section 176B. The cleanser 180 in this embodiment is mounted to the upper section 176B, opposite the biasing device 184.

In use, the upper section 176B moves between an uncompressed state as shown in FIG. 4 and a fully compressed state as shown in FIG. 3. It will be appreciated that the upper section 176B moves in the direction of the base section 176B against a biasing force generated by the biasing device 184. As a result, as the solid cleanser 80 is worn away, the biasing device 184 keeps the upper surface 190 of the cleanser 80 pressed against the subject's skin during operation of the cleansing workpiece 120.

Figure 5:
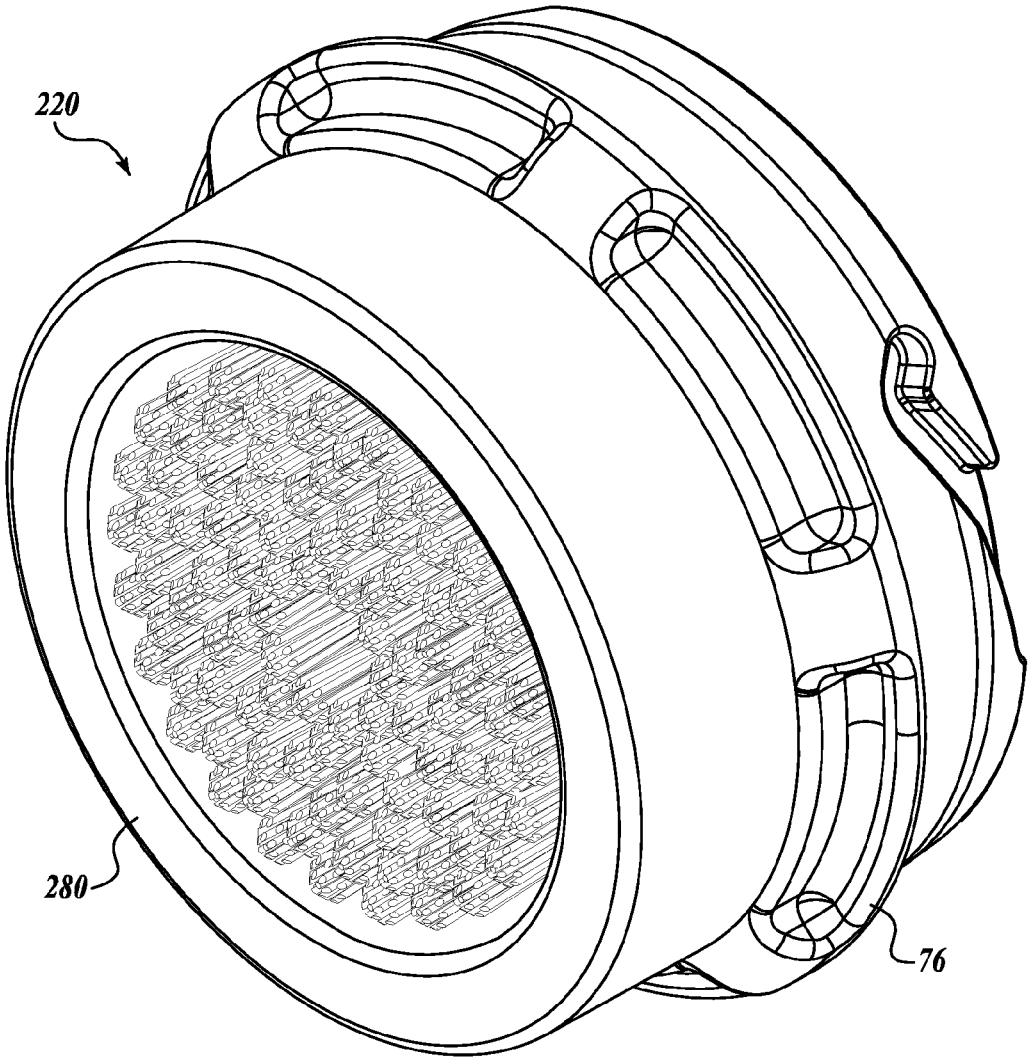
FIG. 5 is a perspective view of another example of a cleansing workpiece formed in accordance with aspects of the present disclosure.

FIG. 5 illustrates another embodiment of a cleansing workpiece 220 having an integrated cleanser device in accordance with aspects of the present disclosure. The cleansing workpiece 220 is substantially similar in construction and operation as the cleansing workpiece 20 except for the differences that will now be described. As shown in FIG. 5, instead of the solid cleanser 80, the cleansing workpiece 220 includes a cleanser container 280, for example, a ring-like container that holds or carries a liquid cleanser (hidden in FIG. 5). In the embodiment shown, the cleanser container 280 is coupled to or integrated with the outer retainer 76 and is configured to dispense the liquid cleanser on to the subject's skin prior to and/or during use.

It will be appreciated that any dispensing technique may be practiced with embodiments of the present disclosure. In some embodiments, the cleanser container 280 is formed by or includes a porous matrix impregnated with a liquid cleanser, as shown in FIG. 5. In some embodiments, the porous matrix includes a polymeric (e.g., elastomeric) matrix. The liquid cleanser can be passively dispensed from the porous matrix when contacting the subject's skin in some embodiments. In other embodiments, the liquid cleanser can be actively dispensed from the porous matrix upon a condition, such as by the application of an electric field, heat, light, or the like.

Figure 7:
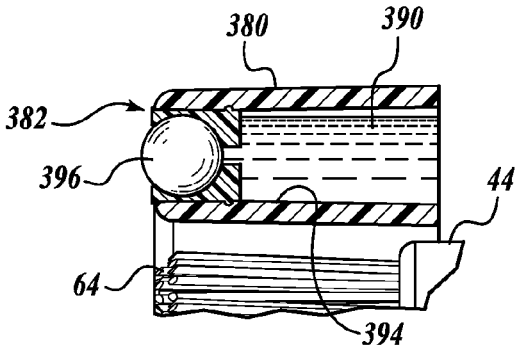
FIG. 7 is a partial cross sectional view of the cleansing workpiece of FIG. 6.
Figure 6:
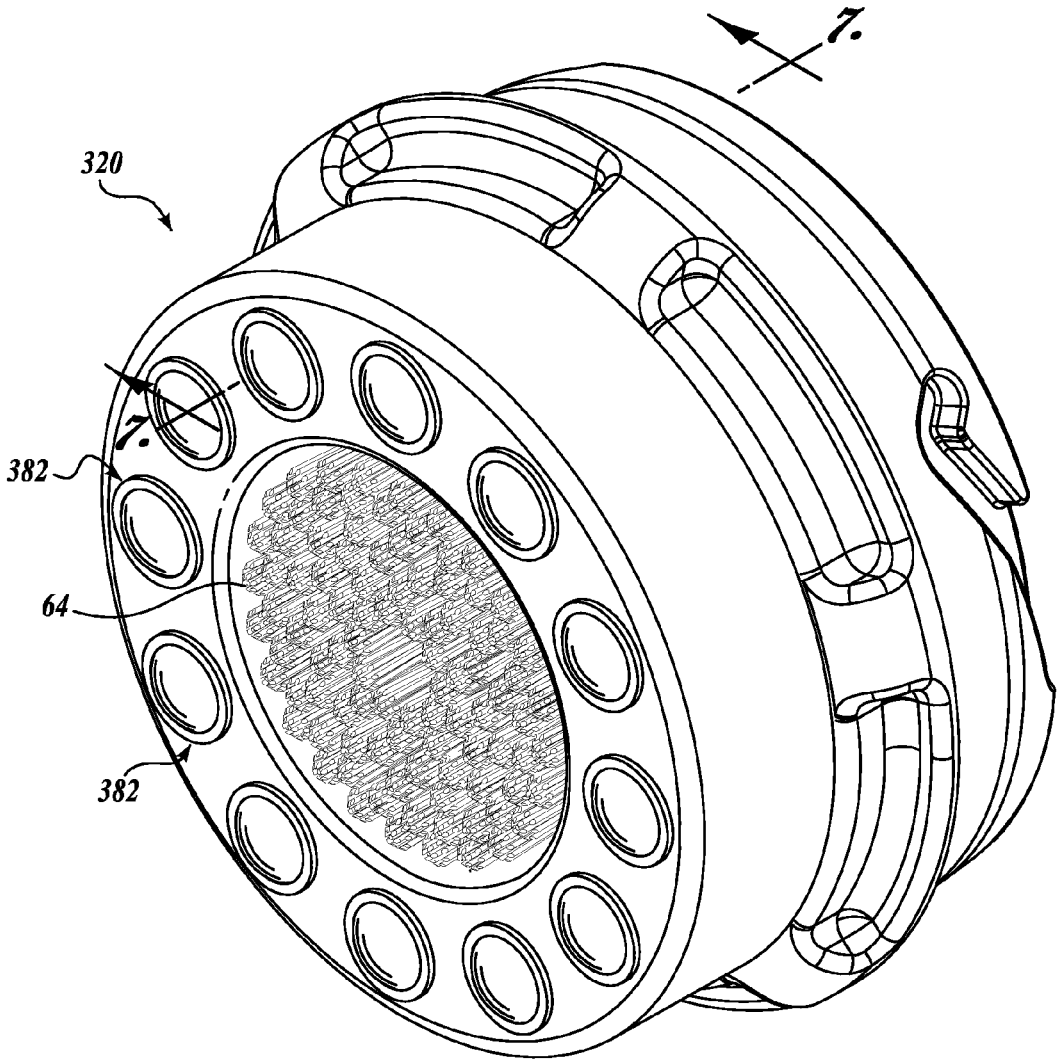
FIG. 6 is a perspective view of yet another example of a cleansing workpiece formed in accordance with aspects of the present disclosure.

Other dispensing techniques include a hollow cleanser container having a reservoir for storing the liquid cleanser. For example, the cleansing workpiece 320 in FIGS. 6-7 employ a number of applicators 382 of the roll-on ball type, which are operatively coupled to the top surface of the cleanser container 380. The roll-on ball applicators 382 are disposed somewhat planar with the tips of bristles 64. The roll-on ball applicators 382 communicate with the liquid cleanser 390 stored in reservoir 394, as shown in the partial cross-sectional view of FIG. 7. In use, the roll-on ball applicators 382 transfer the liquid cleanser 390 from the reservoir 394 to the subject's skin in a manner well known in the art. In some embodiments, the reservoir 394 is refillable. In alternative embodiments, the roll-on ball applicators can be replaced by any other dispensing means, e.g., an optionally flocked endpiece, a foam, a felt, etc.

Other techniques for dispensing the liquid cleanser can be employed in embodiments of the present disclosure. For example, in some embodiments, a motive force is provided that dispenses the liquid cleanser from the container. The motive force can be generated by any suitable mechanical or electrical means, and can push the liquid cleanser through, for example, small holes or other openings in the top surface of the container. The motive force can be applied prior to use, such as via an advancing piston manually actuated by the subject, or can be applied during use, such as via an advancing piston, the movement of which is automated during use of the cleansing device. In other embodiments, the cleanser container can be configured such that the liquid cleanser stored in the reservoir diffuses through the walls of the cleanser container for dispensing thereof.

The above-described examples of the cleansing workpiece 20, 120, 220, 320 can be used to clean, massage, and/or exfoliate a subject's skin. In that regard, any cleansing workpiece herein disclosed may be first attached, for example, to the personal care appliance 22. The personal care appliance 22 is then turned on in some treatment methods, and the attached cleansing workpiece is operated at sonic frequencies in the range of about 40-350 Hz, oscillating the cleansing workpiece back and forth within a range of about 3-45 degrees.

Once oscillating, the cleansing workpiece is applied against the skin on the body of a subject, such as on the face. As the cleansing workpiece is applied against the skin, cleanser is dispensed onto the skin and interacts with the cleansing component, such as bristles, of the cleansing workpiece. Cleanser may be continually applied during use of the cleansing workpiece. Once the skin is treated to the desired amount, the cleansing workpiece can be removed from the skin and the appliance 22 can be powered down. Alternatively, the appliance 22 can be powered down automatically via a programmed operation.

It should be noted that for purposes of this disclosure, terminology such as "upper," "lower," "vertical," "horizontal," "inwardly," "outwardly," "inner," "outer," "front," "rear,"

etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. A cleansing workpiece, comprising:

a cleansing body having an interface configured for coupling to a powered personal appliance, the cleansing body including a movable central member and an outer retainer including a first discrete section and a second discrete section, the first discrete section being capable of movement with respect to each of the movable central member and the second discrete section;

a plurality of tufts each including a plurality of bristles extending outwardly from the movable central member of the cleansing body; and a cleanser carried by the first discrete section of the cleansing body.

2. The cleansing workpiece of claim 1, wherein the cleanser is one of a liquid cleanser and a solid cleanser.

3. The cleansing workpiece of claim 1, wherein the cleanser includes one of a soap and detergent.

4. The cleansing workpiece of claim 1, wherein the cleanser is impregnated into a porous matrix.

5. The cleansing workpiece of claim 1, wherein the cleanser is a solid cleanser mounted to the cleansing body and extending outwardly in the direction of the bristles.

6. The cleansing workpiece of claim 1, wherein a biasing device is disposed in-between the first discrete section and the second discrete section.

7. The cleansing workpiece of claim 6, wherein the first discrete section is capable of movement in the direction of the second discrete section against a biasing force generated by the biasing device.

8. The cleansing workpiece of claim 7, wherein the biasing device is selected from a group consisting of a coil spring, a Belleville washer, an elastomeric bushing, and a leaf spring.

9. The cleansing workpiece of claim 1, further comprising a reservoir configured to store the cleanser, wherein the cleanser includes a liquid cleanser.

10. The cleansing workpiece of claim 9, further comprising an applicator that communicates with the reservoir and is configured to transfer the liquid cleanser from the reservoir to a subject's skin.

11. A cleansing workpiece, comprising:

a cleansing body having an interface configured for coupling to a powered personal appliance, the cleansing body including a movable central member configured to be moved by the powered personal appliance and an outer retainer including a first discrete section and a second discrete section, the first discrete section being capable of movement independent of movements of the movable central member by the powered personal appliance;

a plurality of tufts each including a plurality of bristles extending outwardly from the movable central member of the cleansing body; and means for dispensing a cleanser onto a subject's skin, wherein said means for dispensing a cleanser is carried by the first discrete section of the cleansing body.

* * * * *